US005213159A

United States Patent [19]

Schneider

[11] Patent Number: 5,213,159

[45] Date of Patent: May 25, 1993

[54] METHOD AND APPARATUS FOR MONITORING WELL FLUID PARAMETERS

[76] Inventor: John L. Schneider, Beech Wood Place, West Hill, Skene, Aberdeenshire, United Kingdom

[21] Appl. No.: 768,619

[22] PCT Filed: Mar. 30, 1990

[86] PCT No.: PCT/GB90/00482

§ 371 Date: Sep. 30, 1991

§ 102(e) Date: Sep. 30, 1991

[87] PCT Pub. No.: WO90/12196

PCT Pub. Date: Oct. 18, 1990

[30] Foreign Application Priority Data

| | | | |
|---|---|---|---|
| Mar. 31, 1989 | [GB] | United Kingdom | 8907280 |
| Apr. 28, 1989 | [GB] | United Kingdom | 8909879 |
| Sep. 5, 1989 | [GB] | United Kingdom | 8920003 |
| Feb. 12, 1990 | [GB] | United Kingdom | 9003134 |

[51] Int. Cl.[5] ..... E21B 47/00

[52] U.S. Cl. ..... 166/250; 175/48

[58] Field of Search ..... 166/250, 252; 175/48; 73/151, 155

[56] References Cited

U.S. PATENT DOCUMENTS

| | | | |
|---|---|---|---|
| 2,745,497 | 5/1986 | Dale . | |
| 3,486,380 | 12/1969 | Culver . | |
| 4,316,386 | 2/1982 | Kerekes | 166/332 X |
| 4,458,945 | 7/1984 | Ayler et al. | 166/77 X |
| 4,581,613 | 4/1986 | Ward et al. | 166/53 X |
| 5,099,919 | 3/1992 | Schneider et al. | 166/188 |

FOREIGN PATENT DOCUMENTS 263772 4/1988 European Pat. Off. .

OTHER PUBLICATIONS

The Oil and Gas Journal, vol. 74, No. 9, Mar. 1, 1976, pp. 114, 118.

*Primary Examiner*—Terry Lee Melius

*Attorney, Agent, or Firm*—Florence U. Reynolds

[57] ABSTRACT

Sensing apparatus for monitoring fluid intake and discharge pressure in an oil well comprises an intake pressure transducer mounted at the bottom of an ESP pump string and arranged to sense intake pressure directly and a similarly mounted discharge pressure transducer. A capillary tube is connected at its lower end to the transducer and indirectly at its upper end to a fluid reservoir located in the area of discharge pressure. Valves in the form of alternative nipples are arranged to apply intake or discharge pressure to the fluid reservoir through a port in the wall of the by-pass string. While discharge pressure is normally monitored via the capillary tube, the intake pressure can be monitored in the event of breakdown of the discharge pressure transducer, thus providing redundancy to the system; also the ability to sense intake pressure at two different points enables the system to be calibrated.

20 Claims, 4 Drawing Sheets

METHOD AND APPARATUS FOR MONITORING WELL FLUID PARAMETERS

BACKGROUND OF THE INVENTION

This invention relates to the sensing of fluid parameters in wells, for example oil wells.

Oil wells usually have an outer casing down which is lowered a production string for the passage to the surface of the oil produced by the well. In certain wells it is necessary to have an artifical lift system to bring oil to the surface usually up the production tubing, either because of the lack of sufficient natural reservoir pressure to produce the well or to enhance production from a well that produces under natural pressure. A common system of artificial lift is to place an electrical submersible, or submergible, pump (ESP) down the well casing on the end of the production tubing to pump fluid from the casing up the production tubing. The installation of an ESP on the end of the production tubing eliminates the possibility of carrying out logging or other operations in the well below the production tubing with tools, unless a by-pass system is used to enable tools to be passed through the production tubing and into pump by-pass tubing by means of a Y-crossover sub, known as a Y-tool. Below the Y-tool there thus are two strings:

1) A pump string which produces the well, discharging fluid through the Y-tool into the production tubing to surface.

2) A by-pass tubing string which enables tools from the production tubing to go down past the pump and enter the well below the pump for logging or other operations.

When operating the well it is useful to know a parameter of fluid at the intake to the pump, pressure being the most common as it gives an idea of the fluid level in the well; and it is common practice to determine the value of the intake pressure by a sensor located at the bottom of the pump/motor assembly, power to the sensor and the signal from the sensor being carried by an electrical cable running to the surface, which may be the power cable. Other parameters such as temperature, flow or density may be similarly sensed.

It would also be useful to know a corresponding parameter on the discharge side of the pump, for example the pressure in order to give an indication of the efficiency of the pump.

SUMMARY OF THE INVENTION

According to a first aspect of the present invention there is provided a method of monitoring parameters of fluid being pumped from a well, for example an oil well, comprising sensing a fluid parameter on the intake side of the pump, characterized in that a corresponding fluid parameter is also sensed on the discharge side of the pump or in the production string. It would be very expensive to run a pressure discharge sensor down the well on the end of a separate cable and the intake and output discharge parameters are preferably transmitted to the surface by the same route. More preferably signals indicative of the intake and discharge parameters are generated at a common location.

According to a second aspect of the present invention there is provided sensing apparatus for use with a downhole pump in a well, for example, an oil well, comprising a sensor arranged to sense a fluid parameter, for example pressure or temperature, of fluid in the annulus, i.e. on the intake side of the pump, characterized in that a further sensor is arranged to sense a corresponding parameter of fluid on the discharge side of the pump or in the production string.

In one embodiment of the present invention the sensing apparatus may be mounted on the Y-tool, which is preferably provided with a further arm to accommodate the sensing apparatus and which thus takes on the general form of a letter "H", such a modified Y-tool subsequently being referred to as an H-tool. The sensing apparatus is thus afforded a protected environment and an extended working life. Moreover, the positioning of the sensor on a modified Y-tool, and preferably on an H-tool, allows not only the parameters of fluid in the annulus to be sensed but additionally such parameters of fluid entering the tool from the by-pass string or from the pump discharge also to be sensed directly.

Although the electrical connection from the sensing apparatus located in the H-tool may be "spliced" into the main power cable at a cable junction box also located on the H-tool, such a connection is very complicated to arrange, and in another embodiment of the present invention the need for such a "splice" into the main cable (or to run a separate cable to the surface) is avoided.

According to another embodiment of the present invention the electrical connection to the surface of a sensor unit located in the H-tool (or in an equivalent position) is via a cable running downwardly from the H-tool to a connection with the main power cable supplying the electric submersible pump (ESP) motor(s). Preferably the connection is made to the power cable by means of an adaptor located at the bottom of the motor section. As this location is one conventionally occupied by a sensor, the arrangement according to the present embodiment can utilize available connections.

There are advantages in having the sensing apparatus according to the present invention located near the pump intake, for example in the conventional position at the bottom end of the ESP.

According to yet another embodiment of the present invention the sensing apparatus is located such that it may sense directly the one or more parameters of fluid in the annulus, i.e. on the intake side of the pump, and sense remotely the one or more parameters of fluid on the discharge side of the pump or in the production string.

Preferably the sensing apparatus according to the embodiment is located in the position at the bottom of the ESP string; and the remotely sensed parameter is sensed at an H-tool as described above; at a conventional Y-tool; or at a special sub-assembly.

Where the parameter to be sensed at the discharge side is pressure, it is preferably transmitted from a pressure reservoir through a capillary tube filled with a "barrier" fluid to a transducer located near the intake transducer; where the parameter is temperature it may be sensed by a thermistor located on the discharge side and electrically connected to the sensing apparatus; where the parameter is density the parameter may be arranged to be transmitted electrically to the sensing apparatus by a suitable gradiomanometer located in fluid on the discharge side; and, where the parameter is flow volume and velocity, the parameter may be transmitted electrically by a suitable flow measuring apparatus.

In a particularly preferred embodiment of the invention where fluid intake and discharge pressures are to be monitored the sensing apparatus comprises an intake pressure transducer arranged to sense intake pressure directly, a discharge pressure transducer, a capillary tube connected at its lower end to the discharge pressure transducer and at its upper end to a fluid reservoir located in the area of discharge pressure, and valve means arranged to apply intake or discharge pressure to said fluid reservoir.

While the discharge pressure would normally be monitored via the capillary tube, the intake pressure could be monitored in the event of breakdown of the transducer normally monitoring intake pressure, thus providing redundancy to the system. The ability to sense the value of the intake pressure at two different points confers the additional advantage of enabling the system to be calibrated.

The valve means may comprise a nipple in the area of the discharge flow, a port connecting the area of discharge flow to the fluid reservoir, an intake valve tool arranged to co-operate with said nipple and to seal the by-pass tubing above the port to cause intake pressure to be applied to said fluid reservoir, and a discharge valve tool also arranged to co-operate with said nipple but to seal the by-pass tubing below said port to cause discharge pressure to be applied to said fluid reservoir.

Although the intake and discharge valves preferably take the form of separate wireline tools they may be combined together in a single tool.

Although the invention may be carried out in a variety of ways one particular embodiment thereof will now be described, by way of example, with reference to the accompanying drawings.

DETAILED DESCRIPTION

Figure 1:
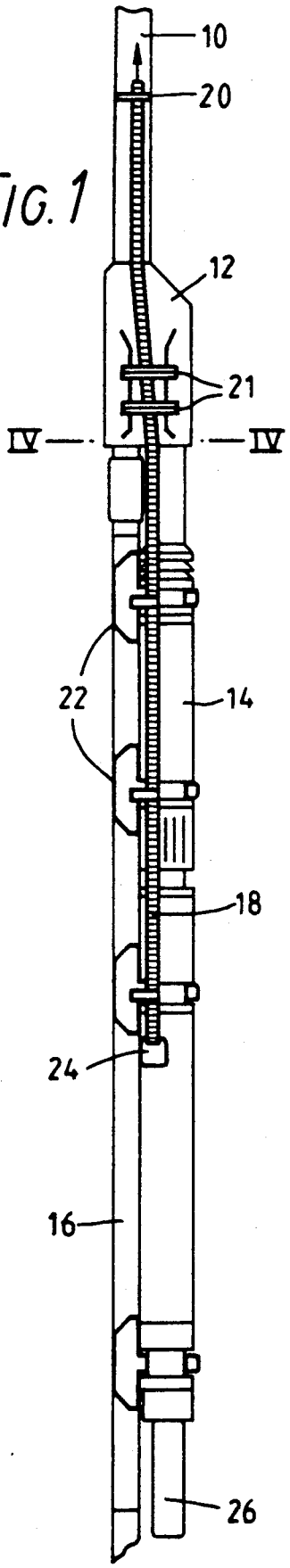
FIGS. 1 and 2 are each a diagrammatic elevation from opposite directions of a sensing system according to the invention installed in a well (the casing being omitted) in conjunction with an ESP assembly.
Figure 2:
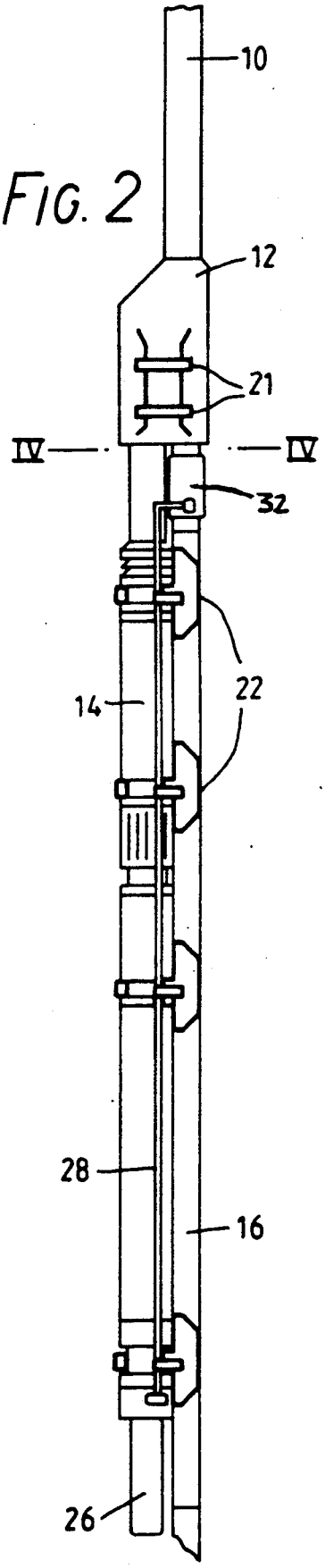

Referring first to FIGS. 1 and 2 there is shown the lower end of a production tubing string 10 which is connected to a Y-tool 12, from the lower arms of which depend an ESP assembly 14 and a by-pass tubing 16. A motor power cable 18 for the ESP assembly is secured to the string 10 by a clamp 20; to the Y-tool 12 by clips 21; and to the by-pass tubing 16 by clamps 22. The cable 18 terminates in the electrical connection 24.

A multi-sensor 26 is secured to the bottom of the ESP assembly 14 which provides an internal electrical connection to power cable 18; alternatively the sensor 26 is connected by a separate cable directly to the surface. From the multi-sensor 26 capillary tubes 28,30 (30 not being seen in FIG. 2) filled with a barrier fluid run up to a reservoir 32 below the Y-tool 12. Immediately below the Y-tool the by-pass tubing 16 is constituted by a nipple to accept wireline valve tools, both the nipple and tools to be described in detail later.

Figure 3:
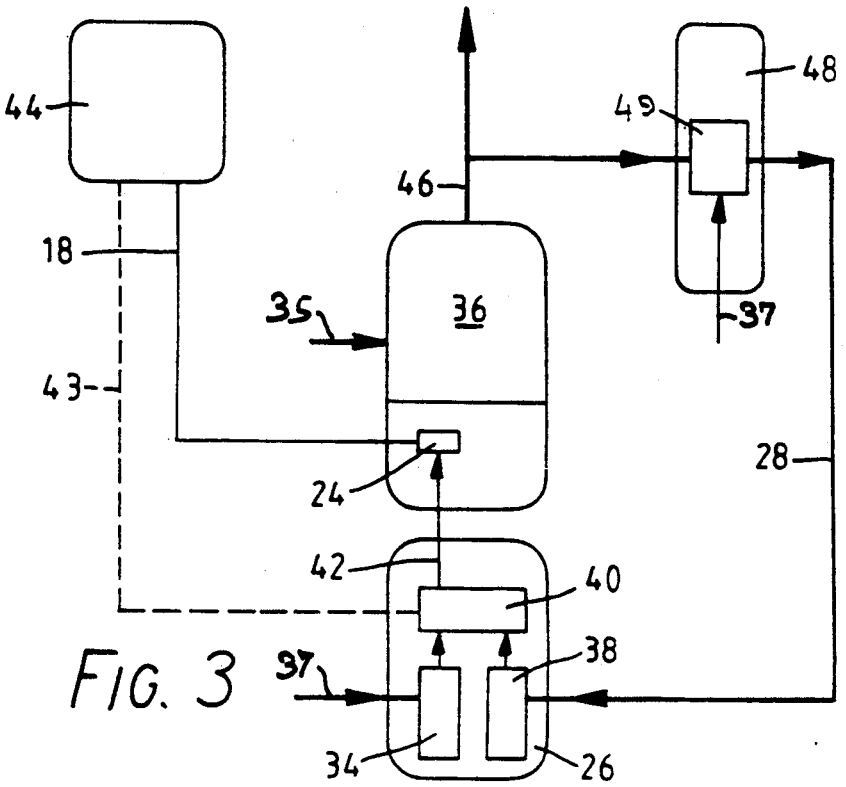
FIG. 3 is a block diagram showing the fluid and electrical connections of the sensing system.

The arrangement of the sensor system according to the embodiment is shown schematically in FIG. 3. The multi-sensor 26 comprises an intake pressure transducer 34 arranged to sense pressure at the intake 35 of the pump 36, intake pressure being indicated by the arrows 37; a discharge pressure transducer 38 connected to the lower end of the capillary tube 28; and electronic circuitry 40 for converting the outputs of the transducers 34,38 into signals for transmission to the surface via an internal connection 42 to the pot head 24 and the motor power cable 18. At the surface electronics 44 provide digital and analogue printouts of the signals from the multi-sensor 26. Alternatively the signals may be transmitted via a separate cable 43.

The pressure of discharge from the pump 36, indicated schematically in FIG. 3 by the broad arrow 46, is communicated via a valve system 48 to a pressure reservoir 49, the pressure in which is indirectly communicated to the capillary tube 28.

Figure 4:
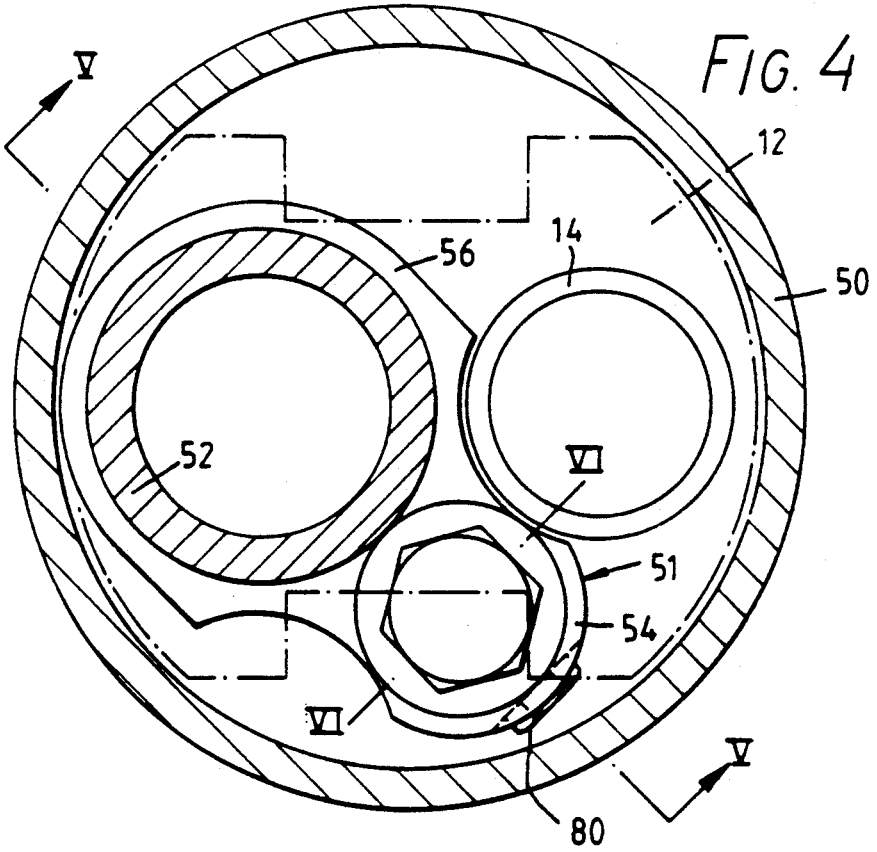
FIG. 4 is a section on the lines IV—IV in FIGS. 1 and 2.
Figure 5:
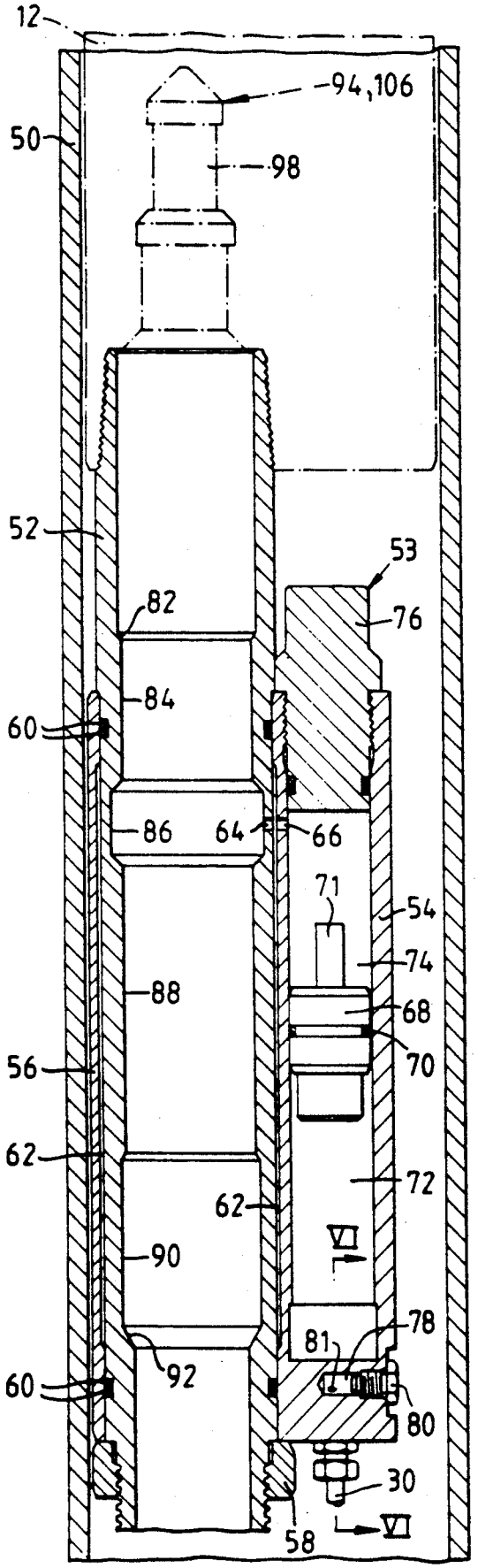
FIG. 5 is a detailed longitudinal section on the line V—V in FIG. 4.
Figure 6:
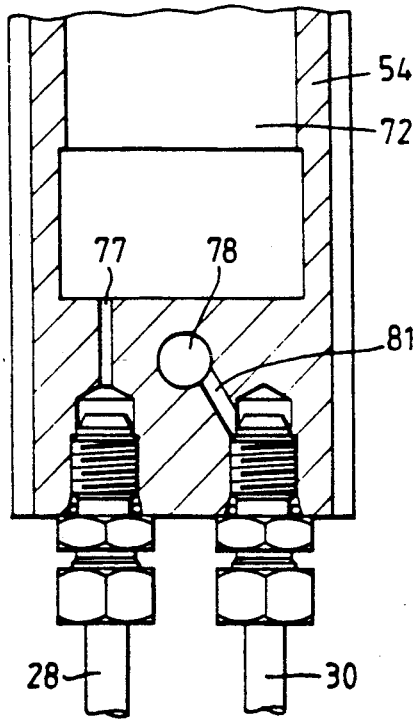
FIG. 6 is a fragmentary section taken on the line VI—VI of FIG. 4.

Referring now to FIGS. 4, 5 and 6, there is shown in phantom, within the well casing 50, the Y-tool 12 into one of the lower connections of which is screwed a nipple 52 forming the topmost portion of the by-pass tubing 16; and into the other connection the upper end of the ESP assembly 14.

The fluid reservoir assembly 53 comprises a tubular body 54 which is mounted against the nipple 52 by means of an integral sleeve 56 which embraces the nipple 52 and is supported thereon by a collar nut 58. The bore of the sleeve 56 is sealed to the nipple 52 at its upper and lower ends by 0-rings 60 and slightly enlarged therebetween to form an annular chamber 62 which communicates with the interior of the nipple 52 through a port 64, and with the reservoir 53 through a port 66. Slidably received within a bore formed in the reservoir body 54 is a floating piston 68 sealed to the bore by O-ring 70 and having a limit stop 71 mounted thereon. The piston 68 divides the bore into a lower chamber 72 and an upper chamber 74 closed by a threaded cap 76. The upper end of the primary capillary tube 28 communicates with the lower chamber 72 via the drilling 77; and the upper end of the filler capillary tube 30 with a radial inlet 78 closable by a filler plug 80 via an oblique drilling 81. The provision of the second capillary tube 30 enables the lower chamber 72 and both capillary tubes 28,30 to be filled with a high-density, low-expansion fluid which ensures that the pressure obtaining in the lower chamber 72 is the same as that applied to the remotely-positioned discharge pressure transducer 38. The floating piston 68 accurately transmits the pressure obtaining in the upper chamber 74 to the lower chamber 72 but prevents contamination of the fluid therein by well fluid should a leak occur in the capillary system. The pressure obtaining in the nipple 52 and which is communicated to the upper chamber 74 through ports 64,66 may be either intake pressure or discharge pressure, the changeover being accomplished by a valve system which will now be described, firstly with particular reference to the internal configuration of the nipple 52 shown in FIG. 5, which forms a valve seat.

As seen in FIG. 5 the internal profile of the nipple 52 comprises an upper shoulder 82 constituting a no-go, an upper sealing land 84, an annular recess 86 in the region of the port 64, a lower sealing land 88, and an enlarged section 90 terminating in a lower shoulder 92.

Figure 7:
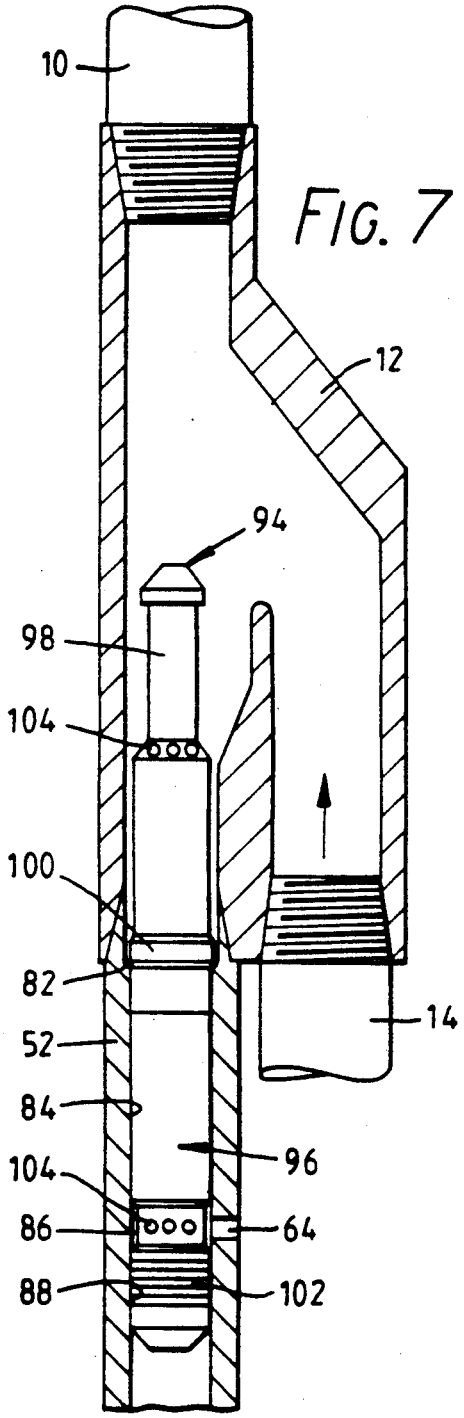
FIG. 7 is a diagrammatic section generally corresponding to FIG. 5 and showing a discharge valve tool in place in the by-pass tubing; and, FIG. 8 is a similar to FIG. 7 but showing an intake valve tool in place.

Referring now to FIG. 7 there may be seen a discharge pressure valve 94 having a body 96 and a conventional neck 98, and provided with locking dogs or a hold-down (not shown) which enable it to be secured in position in the nipple 52 when a collar 100 locates against the shoulder 82. At its lower end the body 96 is provided with seals 102 which seal against the surface 88, thus allowing pump discharge pressure in the Y-tool 12 to be communicated to the port 64 via internal channels 104 formed in the body 96, and the annular recess 86. Thence the discharge pressure is communicated to the discharge pressure transducer 38 along the previously-described route.

Figure 8:
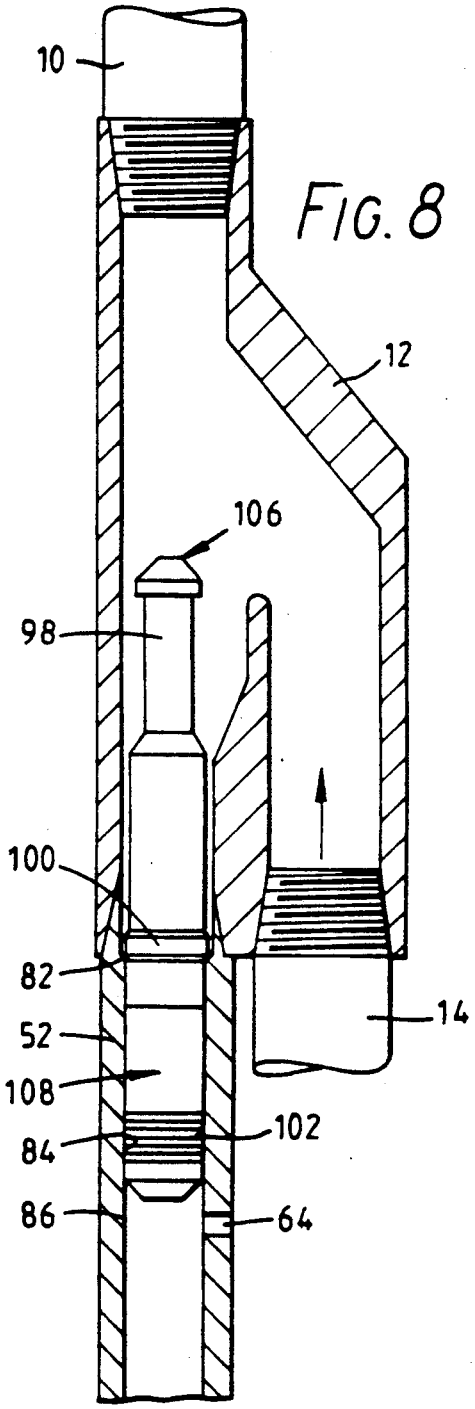

If it is desired to use the discharge pressure transducer 38 to sense intake pressure the discharge valve 94 is removed and an intake pressure valve 106 (see FIG. 8) run down the well on the wireline in the usual way.

The valve 106 has a solid body 108 surmounted by a neck 98 and provided with a collar 100 for sealing against the shoulder 82, both the neck and collar being as previously described with reference to FIG. 7. However, the seals 102 are arranged to seal against the upper sealing surface 84, thus closing the port 64 to pump discharge pressure and opening it to pump intake pressure obtaining in the by-pass tubing 16 and in the annulus. Pump intake pressure (See arrow 37 in FIG. 3) is thus communicated to the discharge pressure transducer 38, which is a useful alternative in the event of failure of the intake pressure transducer 34 or a need to calibrate the system.

In another embodiment the capillary connection 28 may be replaced by an electrical connection to a sensor located in the pressure reservoir 49.

I claim:

1. A method of monitoring parameters of fluid being pumped from a well, for example an oil well, comprising sensing a fluid parameter in the annulus or on the intake side of the pump, and separately sensing a corresponding fluid parameter on the discharge side of the pump or in the production string, characterized in that said corresponding fluid parameter is sensed outside the flow path of fluids discharged by the pump.

2. A method as claimed in claim 1, wherein the intake and output discharge parameters are transmitted to the surface by the same route.

3. A method as claimed in claim 1, wherein signals indicative of the intake and discharge parameters are generated by respective sensors located near each other.

4. Sensing apparatus for use with a downhole pump in a well, for example, an oil well, comprising a sensor arranged to sense a fluid parameter, for example pressure or temperature, of fluid in the annulus or on the intake side of the pump and a further sensor arranged to sense a corresponding parameter of fluid on the discharge side of the pump or in the production string, characterized in that the sensors are arranged outside the flow path of fluids discharged by the pump.

5. Sensing apparatus as claimed in claim 4 and mounted on a Y-tool.

6. Sensing apparatus as claimed in claim 5 and accommodated in a further arm of the Y-tool.

7. Sensing apparatus as claimed in claim 4, and further comprising a cable running downwardly from a sensor located at the Y-tool or at an equivalent location to a connection with a main power cable supplying an electric submersible pump.

8. Sensing apparatus as claimed in claim 4 and located such that it may sense directly the one or more parameters of fluid in the annulus or on the intake side of the pump, and sense remotely the one or more parameters of fluid on the discharge side of the pump or in the production string.

9. Sensing apparatus as claimed in claim 8 and additionally comprising valve means which in one condition allow said further sensor to sense a parameter on the discharge side of the pump and in another condition allow said further sensor to sense a parameter on the intake side of the pump.

10. Sensing apparatus as claimed in claim 8 and located in a position at the bottom of an electric submersible pump assembly and the remotely sensed parameter is sensed at a Y-tool or at an equivalent location.

11. Sensing apparatus as claimed in claim 10, in which the parameter to be sensed at the discharge side is pressure and the sensed value is arranged to be transmitted from a pressure reservoir through a capillary tube filled with a pressure-transmitting fluid to a discharge pressure transducer located near an intake pressure transducer.

12. Sensing apparatus for use with a downhole pump in a well, comprising an intake pressure transducer arranged to sense intake pressure directly; a discharge pressure transducer arranged to sense discharge pressure in a fluid reservoir located in the area of discharge pressure remote from the discharge pressure transducer; and valve means arranged to apply intake or discharge pressure to said fluid reservoir.

13. Sensing apparatus as claimed in claim 12 and additionally comprising a capillary tube connected at its lower end to the discharge pressure transducer and at its upper end to the fluid reservoir, the tube being filled with a pressure-transmitting fluid for communicating pressure obtaining in said reservoir to the discharge pressure transducer.

14. Sensing apparatus as claimed in claim 13, in which the discharge pressure transducer is located near the intake pressure transducer.

15. Sensing apparatus as claimed in claim 12, in which the valve means comprise a nipple in the area of the discharge flow, a port connecting the area of discharge flow to the fluid reservoir, an intake valve tool arranged to co-operate with said nipple and to seal the by-pass tubing above the port to cause intake pressure to be applied to said fluid reservoir, and a discharge valve tool also arranged to co-operate with said nipple but to seal the by-pass tubing below said port to cause discharge pressure to be applied to said fluid reservoir.

16. Sensing apparatus as claimed in claim 15, in which the intake and discharge valve tools take the form of separate wireline tools.

17. A method as claimed in claim 2, wherein signals indicative of the intake and discharge parameters are generated by respective sensors located near each other.

18. Sensing apparatus as claimed in claim 5, and further comprising a cable running downward from a sensor located at the Y-tool or at an equivalent location to a connection with a main power cable supplying an electric submersible pump.

19. Sensing apparatus as claimed in claim 9, and located in a position at the bottom of an electric submersible pump assembly and the remotely sensed parameter is sensed at a Y-tool or at an equivalent location.

20. Sensing apparatus as claimed in claim 13, in which the valve means comprise a nipple in the area of the discharge flow, a port connecting the area of discharge flow to the fluid reservoir, an intake valve tool arranged to co-operate with said nipple and to seal the by-pass tubing above the port to cause intake pressure to be applied to said fluid reservoir, and a discharge valve tool also arranged to co-operate with said nipple but to seal the by-pass tubing below said port to cause discharge pressure to be applied to said fluid reservoir.

* * * * *